US008844178B2

(12) United States Patent
Myers

(10) Patent No.: US 8,844,178 B2
(45) Date of Patent: Sep. 30, 2014

(54) CHECK PRESENTER

(71) Applicant: John G. Myers, Coatesville, PA (US)

(72) Inventor: John G. Myers, Coatesville, PA (US)

( * ) Notice: Subject to any disclaimer, the term of this patent is extended or adjusted under 35 U.S.C. 154(b) by 0 days.

(21) Appl. No.: 13/960,035

(22) Filed: Aug. 6, 2013

(65) Prior Publication Data

US 2014/0033582 A1 Feb. 6, 2014

Related U.S. Application Data

(60) Provisional application No. 61/742,213, filed on Aug. 6, 2012.

(51) Int. Cl.

| | |
|---|---|
| ***B42D 3/00*** | (2006.01) |
| ***B42F 7/02*** | (2006.01) |
| ***G09F 1/10*** | (2006.01) |

(52) U.S. Cl.

CPC .. *G09F 1/10* (2013.01); *B42D 3/00* (2013.01); *B42F 7/02* (2013.01)

USPC ..... 40/124.01; D21/376; 40/299.01

(58) Field of Classification Search

CPC ..... B42D 3/08

USPC ..... 40/124.01, 299.01, 359, 360; D21/376

See application file for complete search history.

(56) References Cited

U.S. PATENT DOCUMENTS

| | | | | |
|---|---|---|---|---|
| D279,303 | S * | 6/1985 | Koga | D21/376 |
| 4,794,877 | A | 1/1989 | Pollard-Smith | |
| 5,355,115 | A | 10/1994 | Goor | |
| 5,654,050 | A * | 8/1997 | Whalen-Shaw | 428/35.7 |
| 6,050,214 | A * | 4/2000 | OKeefe | 116/323 |
| 6,796,673 | B1 | 9/2004 | Dempsey | |
| 6,808,208 | B2 | 10/2004 | Ward | |
| 7,163,307 | B1 | 1/2007 | Clark | |
| 7,270,437 | B1 | 9/2007 | Racoosin | |
| 7,559,665 | B1 | 7/2009 | Pfanstiehl | |
| D670,344 | S * | 11/2012 | Volcani | D21/376 |
| D686,413 | S * | 7/2013 | Bartos | D3/247 |
| 2004/0099546 | A1 | 5/2004 | Schlosser | |
| 2007/0253187 | A1 * | 11/2007 | Cohan et al. | 362/98 |
| 2008/0000117 | A1 | 1/2008 | Marshall | |
| 2008/0184604 | A1 * | 8/2008 | Christensen | 40/359 |
| 2009/0159478 | A1 | 6/2009 | Pfanstiehl | |

FOREIGN PATENT DOCUMENTS

DE 2933319 A * 3/1980

OTHER PUBLICATIONS

"Frankman Design," http://web.archive.org/web/20110515073446/http://www.frankmandesign.co-uk/portfolio-of-work/hammett-associates.php, May 15, 2011.

"ClearGuard Products," http://web.archive.org/web/20130703072529/http://www.clrgrd.com/check-presenters.html, Jul. 3, 2013. Upon information and belief, the same or similar page is believed to have been accessible on or before Apr. 5, 2013.

(Continued)

*Primary Examiner* — Casandra Davis

(74) *Attorney, Agent, or Firm* — Howson & Howson LLP

(57) ABSTRACT

The application is directed to check presenters having contrasting colors/tones on the exterior sides thereof. The contrast permits a restaurant server to determine whether payment has yet been enclosed or not, so that payment may be processed in a timely manner and yet without the need to interrupt a customer to determine whether or not payment has yet been enclosed.

18 Claims, 3 Drawing Sheets

(56) References Cited

OTHER PUBLICATIONS

"ClearGuard Products," http://web.archive.org/web/20120807070853/http://www.clrgrd.com/check-presenters.html, Aug. 7, 2012.

"ClearGuard Products," http://web.archive.org/web/20120701063012/http://www.clrgrd.com/check-presenters.html, Jul. 1, 2012.

Nov. 4, 2013 Office Action in co-pending, co-owned, U.S. Appl. No. 13/960,013.

* cited by examiner

CHECK PRESENTER

CROSS-REFERENCE TO RELATED APPLICATIONS

This application claims the benefit of the priority of U.S. Provisional Patent Application No. 61/742,213, filed Aug. 6, 2012, which application is incorporated by reference herein in its entirety.

BACKGROUND OF THE INVENTION

Restaurant servers place the classic uniform, one-color, check presenter at a customer's table with the guest check enclosed. The customer, at the customer's convenience, then opens the presenter, encloses either cash or credit card as payment, removes the customer's copy of the bill, and closes the presenter.

SUMMARY OF THE INVENTION

The embodiments of the application address a need in the art for a check presenter that permits a restaurant server to know whether a customer has enclosed payment within the check presenter, without having to interrupt the customer who has not yet enclosed payment and without delaying the customer who has enclosed payment. Provided herein is a two-color/two-tone check presenter having a light color/tone/pattern on one exterior side of the presenter and a dark/opposing color/tone/pattern on the other exterior side of the presenter. In some embodiments, regardless of the number of folds of the presenter, a face of the check presenter should be clearly worded to remind the customer to face the appropriate side of the presenter "up" when payment is ready.

DETAILED DESCRIPTION OF THE INVENTION

The problem with the check presenters known in the art is that restaurant servers do not have X-ray eyes, nor are they mind readers. This results in a persistent problem for restaurant servers and customers alike when it comes time for customers to pay the bill. Conventionally, the server places the classic uniform-color check presenter at the customer's table with the guest check enclosed. The customer, at the customer's convenience, then opens the presenter, encloses either cash or credit card as payment, removes the customer's copy of the bill, and closes the presenter.

Figure 1:
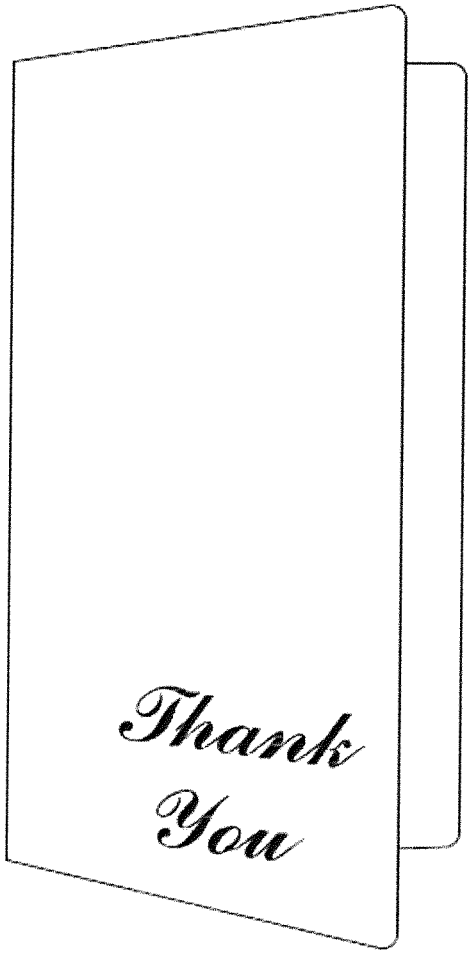
FIG. 1 shows a perspective view of a check presenter as used in the art.

The problem arises when the server later returns or passes by the customer's table. The server cannot tell by looking at the uniform guest check presenter (see, e.g., FIG. 1) whether the customer has enclosed payment. There are no visual clues as to whether the customer's payment has yet been enclosed. The server can either interrupt the customer to inquire whether payment is enclosed, or assume the customer has not yet enclosed payment and therefore does not approach the table to retrieve the check presenter. If the server guesses wrong either way, the customer can be interrupted, inconvenienced, or delayed. If the customer has not yet enclosed payment but is approached by the server for the check presenter, the customer is then unnecessarily interrupted (or if the server mistakenly grabs the check presenter without asking and leaves the table without payment enclosed, such a misunderstanding can cause both embarrassment for the server and irritation/discomfort on the part of the customer). Or, the server can decide not to interrupt the customer, believing payment has not yet been enclosed and the customer is requiring of more time. However, if the customer has in fact already enclosed payment and is now waiting for the server to retrieve the check presenter, one of two situations will occur. Either the customer will be inconvenienced by being forced to get the server's attention that payment is ready and the check presenter should be retrieved, or the customer sits in silence wondering why the server has not yet come by to pick up the presenter and process the enclosed payment. These preventable situations result in added stress and work for the server, irritation and unnecessary delay for the customer, and slower than necessary turnover of tables for the restaurant.

Figure 3:
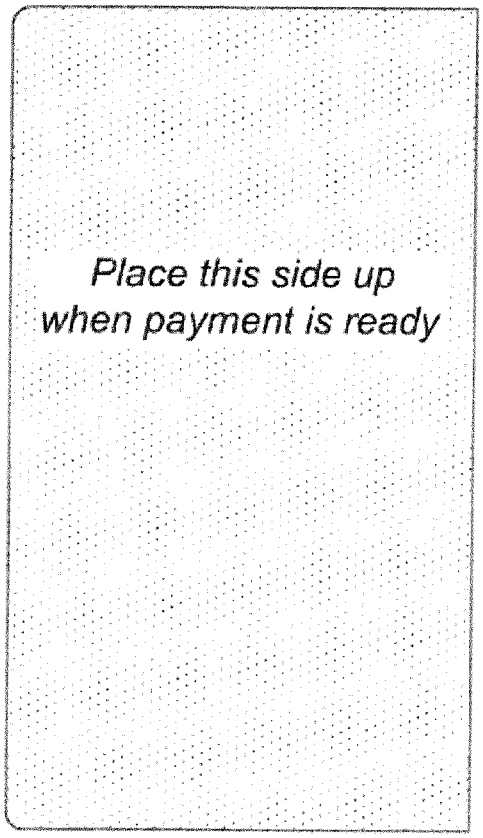
FIG. 3 shows a front view of the exterior back of a check presenter according to an embodiment of the invention. The shading notes a color contrasting with that of FIG. 2.
Figure 4:
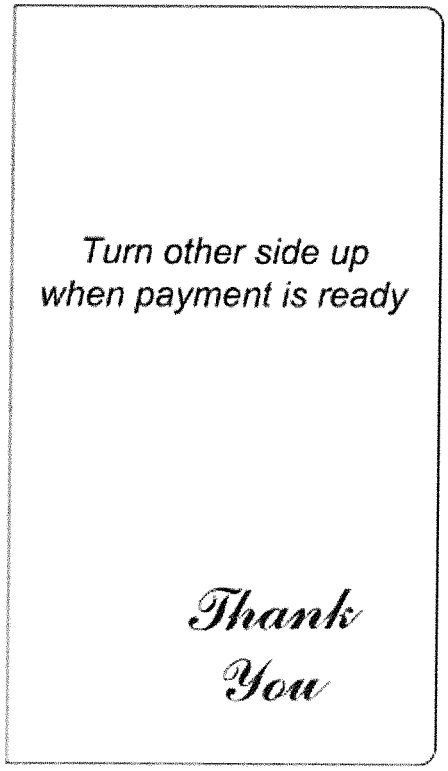
FIG. 4 shows a front view of the exterior front of a check presenter according to an embodiment of the invention.
Figure 5:
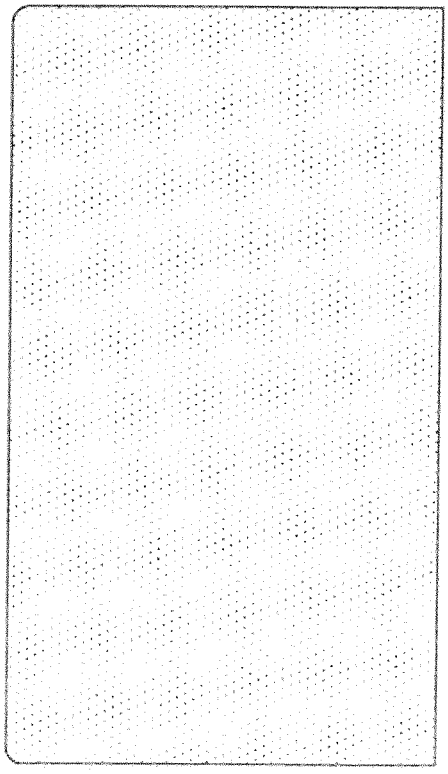
FIG. 5 shows a front view of the exterior back of a check presenter according to an embodiment of the invention. The shading notes a color contrasting with that of FIG. 2.

The embodiments described herein provide 'low-tech' solutions to the problem. A check presenter is provided having an exterior front (e.g., FIG. 2 or FIG. 4) and an exterior back (e.g., FIG. 3 or FIG. 5). The exterior front and exterior back are of opposing colors or tones. The presenter may further have wording (text) on the exterior back (see, for example, FIG. 3), such as "Place this side up when payment is ready", to signal the customer to place the exterior back up (face up) when payment is ready. In the embodiment reflected in FIGS. 4 and 5, language such as "Turn other side up when payment is ready" is placed on the exterior front (FIG. 4). The presence of text on a face of a presenter is an embodiment of the invention, but the invention is not so limited. The solution to the problem identified by the inventor is having the visual clue of one side light and one side dark, with the presenter face up (e.g., one color/tone) meaning 'payment is not ready', and presenter face down (e.g., a different color/tone) meaning 'payment is ready, please process'.

Embodiments having wording on the exterior back, such as "place this side up when payment is ready", or other similar words, remind the customer to place the exterior back of the presenter 'up' so that it will be visible to the server. The contrasting color/tone/pattern serves as the visual clue to the server. The wording on the check presenter may be printed or embossed.

In one embodiment, the exterior front is dark in color/tone and the exterior back is light in color/tone. In another embodiment, the exterior front is light in color/tone and the exterior back is dark in color/tone.

In further embodiments, a credit card holder of the check presenter may be placed such as to entirely enclose the credit card within the presenter. This contrasts with check presenters in which the credit card holder is designed so that the credit card extends out from the inside of the presenter. The visual clue of the protruding credit card is not needed according to the embodiments of the invention, and poses a security risk especially when tables are seated on aisles.

The check presenter described herein may be composed of one, two, three, four, or more panels, each panel having two opposing faces. In one embodiment, the check presenter has one panel. In another embodiment, the check presenter has two panels. In another embodiment, the check presenter has three panels. In yet another embodiment, the check presenter has four panels. In another embodiment, the check presenter has five, six, or more panels.

A panel of a check presenter described herein may have the same appearance on both faces, or the faces may contrast. However, at least one face of a panel of a check presenter must contrast with at least one face of a panel of the check presenter. As used herein, the term contrast is used broadly to define any difference in color, hue, tint, shade, tone, brightness, pattern, or texture visible to a person. Unless otherwise specifically excluded, the use of any of these terms, or simply reference to 'contrast' (or 'contrast in appearance' or the like), is meant to include these terms and others as additional embodiments. By visible it is meant the naked eye, or an eye having corrected vision. The use of fluorescent dyes or the like is also contemplated in conjunction with an ultraviolet light source. Unless otherwise apparent herein in context, the term 'color' is intended to encompass both black and white.

In an embodiment where the check presenter is of a single panel, opposing faces of that panel (both exterior faces) will contrast in appearance. In one embodiment, one face is black and the opposing face is yellow. However one face may be black or any color, such as a primary color red, orange, yellow, green, blue, violet and the other face may be any contrasting color. By way-limiting example, embodiments include: black/red, black/orange, black/yellow, black/green, black/blue, black/violet, red/yellow, red/green, red/blue, etc. Any combination is contemplated, so long as the combination provides a visible contrast. It is noted that certain combinations, while not excluded, may be of more limited use due to 'color blindness' in a server or customer/patron. For example, blue/green.

It is also contemplated that the same color may be used on both faces, but that the different shades or tones of that color are used. Still further, the invention encompasses embodiments where one or more faces have a pattern. Where both faces of a presenter have a pattern, the patterns must differ such as to contrast. In one embodiment, one face of the check presenter is black and the other face is black with a contrasting pattern.

Patterns suitable include, but are not limited to, vertical lines, horizontal lines, cross-hatching (vertical or diagonal), dots, shading, gradient, visual texture (e.g., flat graphic of wood grain), and the like are contemplated.

The choice of contrasting colors, shades, tones, or patterns is near limitless and is not intended to be a limitation of the invention. Further, any combinations known to be effective for contrast may be used and are intended to be encompassed herein. Still further, one, two, three, or more contrasting features, such as colors, shades, tones, or patterns, may be combined to provide contrast. For example, one face could be solid black while the opposing face could be a marbled visual texture of black and white.

In another embodiment, variation in material or physical texture of the material may be used to provide the contemplated contrast. For example leather of a smooth finish could be contrasted with that of a suede finish, or a high polish/sheen can be paired with a matte polish/sheen. Still further, this contrast may be paired with others contemplated herein.

Figure 2:
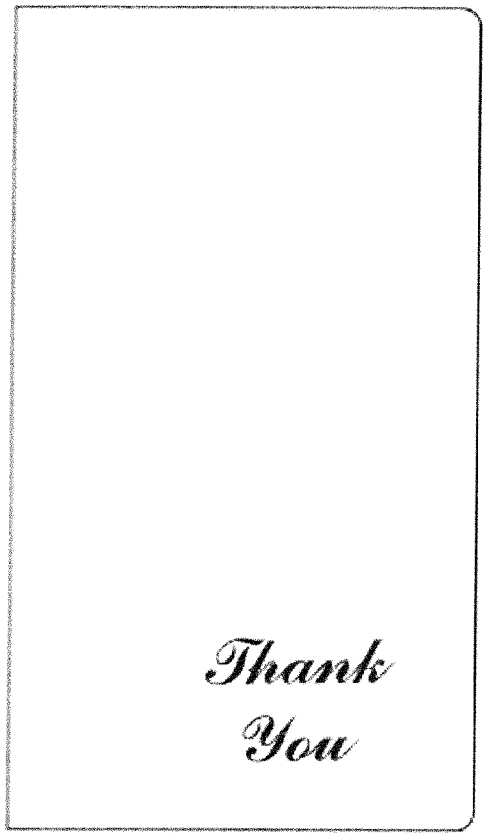
FIG. 2 shows a front view of the exterior front of a check presenter according to an embodiment of the invention.

In embodiments having two or more panels, the panels are joined such as to provide interior faces and exterior faces (when the presenter is closed). In one embodiment, two panels are joined. For example, in the embodiment exemplified in FIGS. 2 and 3, the leftmost side of FIG. 2 is joined to the rightmost side of FIG. 3. FIGS. 2 and 3 reflect the exterior faces of the check presenter. The exterior faces will contrast by color, shade, tone, texture, material and/or physical texture in parallel embodiments to those described above as to a single panel (two opposing faces) composition.

Still further, not shown in the drawings, are embodiments in which the exterior faces contrast with the interior faces. In such an embodiment, the panels of the presenter are joined such that the entire presenter is inverted once payment has been enclosed. For example, with reference to FIGS. 2 and 3, the presenter, having these exterior faces when the check is presented to a table for payment, would be turned 'inside out' such that the faces shown in FIGS. 2 and 3 would face one another. Thus, two originally interior faces are showing/external. In these embodiments, an advantage is provided in that whichever side of the closed presenter is faced up, the server can note the contrast from the presenter as it was delivered.

In one embodiment, at least one exterior face of the presenter is imprinted with a message. In one embodiment, the front exterior face is presented with the message "Thank you," such as is reflected in FIGS. 2 and 4, or other similar expression of gratitude or politeness. In another embodiment, the front exterior face is also imprinted with the direction to the customer to "Turn other side up when payment is ready," such as if reflected in FIGS. 3 and 4, "Please turn presenter inside out when payment is ready," or other similar direction. The text displayed and the font, color, style, or other character thereof is not a limitation of the invention.

In further embodiments of the check presenters, at least one face of at least one panel has a holder for receiving the invoice or bill. In still other further embodiments of the check presenters, at least one face of at least one panel has a holder for receiving a credit card or other payment. In preferred embodiments, it is advantageous that a holder be disposed on a face that will be disposed internally when the presenter is closed with payment for processing. In some embodiments, the holders, such as a credit card holder, may be disposed such that payment is partially external to the borders of the presenter. However, the invention permits a server to identify a check presenter prepared with payment for processing, such that the payment may be entirely contained therein. This ensures confidentiality of any credit card information, among other advantages.

Other features have been described in the art, such as in US Patent Application Publications Nos.: 20040099546 (Schlosser) and 20080000117 (Marshall), which publications and their check presenter features are incorporated herein by reference. The presenters described herein may contain a light, magnifier, calculator, writing instrument (e.g., pen) holder, tip table, mirror, view window, or other feature used in the industry.

Still further specific embodiments are described as follows.

A check presenter as described herein may comprise an exterior front face and an exterior back face, wherein said exterior front face contrasts with said exterior back face. In a further embodiment, the check presenter comprises a single panel, said exterior front face and said exterior back face being disposed on opposite faces thereof.

In another embodiment, said check presenter comprises a first panel comprising said exterior front face and a first interior face and a second panel comprising a second interior face and said exterior rear face. The first panel and said second panel are joined by a flexible hinge. An interior face of the presenter may comprise language signaling the customer to place the exterior back face face-up. Still further, the exterior back face may contrast with the exterior front face and at least one interior face.

The contrast between the exterior front face and the exterior back face may be in color, tone (or shade), pattern. The contrast may also be by other means sufficient to visually signal a server to return, e.g., to indicate that payment has been enclosed.

Still further the check presenter's exterior face may include language signaling the customer to place the exterior back face face-up. In another embodiment, the language may be on the exterior front face. In yet another, the language may be on the exterior rear face.

In another embodiment, a check presenter is provided comprising a first panel having a first face and a second face joined to a second panel having a third face and a fourth face, wherein the joinder permits relative movement of the first panel with respect to the second panel about the joinder to define an open position where the panels rest adjacent each other in the same plane and two closed positions where either the second face and the third face are disposed toward one another or the first face and the fourth face are disposed toward one another, wherein said first face and said fourth face contrast with said second and third faces. The joinder may a flexible hinge.

In further embodiments, one of the faces of the panels comprises language signaling the customer to close the presenter with the first face and the fourth face disposed toward one another. In other embodiments, one of the faces of the panels comprises language signaling the customer to close the presenter with the second face and the third face disposed toward one another, and the first face or fourth face of the panels comprises language signaling the customer to place the first face or fourth face face-up.

In these embodiments, the first and fourth faces contrast with the second and third faces in color, tone (or shade), or pattern. The contrast may also be by other means sufficient to visually signal a server to return, e.g., to indicate that payment has been enclosed.

The check presenters of the invention may be prepared from materials and by methods known in the industry, including those noted within documents referenced herein and incorporated by reference. Panels may be constructed of any sturdy material. The panel material should also be constructed of a durable material. Still further, in some embodiments, the panels are constructed of a material that is readily cleanable or is otherwise consistent with the needs of hygiene and cleanliness in the restaurant industry. The panels may be constructed of, or coated with, any number of materials such as plastics, vinyl, and leather. A panel may be formed of a single piece of material or may be layered, such as with a cardboard interior and a vinyl exterior. Embodiments having two or more panels may be prepared by In embodiments of check presenters having two or more panels, the panels must be joined together. The joinder may be by way of a flexible hinge, spiral binding, ring binding, or other suitable joinder. The joinder may be formed out of the same material as one or more panels, or the exterior/coating material of one or more panels, or may be formed of another material. For example, a spiral binding may be of a material other than the panel exteriors.

If the presenter is made from a one-piece covering, then the front and back faces will have to go through separate dyeing processes. If the faces are stitched together, then the manufacturer will simply be stitching, fusing or otherwise joining together different faces instead of like faces. In the case of multiple panels, a one-piece covering may also be utilized, or two-piece covering combined by stitching, fusing or otherwise joining. In a further embodiment of one- or two-piece coverings, a joinder between two or more panels may be formed by stitching, fusing or otherwise joining the covering on one face of the panels, i.e., one side of the presenter when the presenter is open/flat, to the covering on the opposing face of the panels.

In other embodiments having multiple panels, each panel may be separately covered by a one- or two-piece covering as described above, and those panels may be joined together by any combination of stitching, fusing or otherwise joining In one embodiment, the panels are joined by a spiral binding.

Variances in the manufacturer's process may be determined by the material used to construct and cover the fold(s) and are known in the art and intended to be encompassed.

The edges of the check presenters or panels thereof may be sealed by any means known in the art if they are of multiple-piece construction. In one embodiment, one or more edges of the presenters are heat sealed. However, other fusions are contemplated. In some embodiments, an adhesive or glue is used which is appropriate for the material(s). In still other embodiments, edges are sealed by stitching. The panels may also be constructed such as to have one, two, or more corners capped with another material to resist damage. The material may be a hard plastic, rubber, or metal.

Also provided are methods for delivering billing information to, and receiving payment or payment information from, a customer. These methods may comprise the steps of delivering a check presenter according to claim 1 to the customer with the exterior front face of said check presenter oriented face-up and visually monitoring said check presenter. Still further, an included step may be retrieving the check presenter from the customer when the exterior back face is oriented face-up. In a further embodiment, the methods may comprise the steps of delivering a check presenter to the customer, wherein said check presenter is delivered in a closed position with the second face and third face disposed toward one another, and visually monitoring the check presenter. Still further, an included step may be retrieving the check presenter from the customer when said check presenter is in a closed position with the first face and fourth face disposed toward one another.

All documents listed in this specification are incorporated herein by reference, as is the disclosure of U.S. Provisional Patent Application No. 61/742,213, filed Aug. 6, 2012. While the invention has been described with reference to specific embodiments, it will be appreciated that modifications can be made without departing from the spirit of the invention. Such modifications are intended to fall within the scope of the appended claims.

The invention claimed is:

1. A method for delivering billing information to, and receiving payment or payment information from, a customer, comprising the steps of:

(a) delivering a check presenter to said customer, said check presenter comprising a first panel comprising an exterior front face and a first interior face and a second panel comprising a second interior face and an exterior back face, wherein said exterior front face contrasts with said exterior back face, wherein said check presenter is delivered to said customer with said exterior front face oriented face-up and instruction to orient said exterior back face face-up when payment is ready;

(b) visually monitoring said check presenter; and (c) retrieving said check presenter from said customer when said exterior back face is oriented face-up.

2. The method according to claim 1, wherein a face of said check presenter comprises language signaling the customer to place the exterior back face face-up when payment is ready.

3. The method according to claim 2, wherein said exterior front face comprises language signaling the customer to place the exterior back face face-up when payment is ready.

4. The method according to claim 1, wherein said first panel and said second panel of said check presenter are joined by a flexible hinge.

5. The method according to claim 1, wherein said exterior front face and said exterior back face of said check presenter contrast in color.

6. The method according to claim 1, wherein said exterior front face and said exterior back face of said check presenter contrast in tone.

7. The method according to claim 1, wherein said exterior front face and said exterior back face of said check presenter contrast in pattern.

8. A method for delivering billing information to, and receiving payment or payment information from, a restaurant customer, comprising the steps of:

(a) delivering a check presenter to said restaurant customer, said check presenter comprising a first panel comprising an exterior front face and a first interior face and a second panel comprising a second interior face and an exterior back face, wherein the panels are joined, wherein the joinder permits relative movement of the first panel with respect to the second panel about the joinder to define an open position where the panels rest adjacent each other in the same plane and at least one closed position wherein the first interior face and the second interior face are disposed toward one another, wherein said exterior front face and said exterior back face contrast in color, tone, or pattern with said first interior face and said second interior face;

and wherein said check presenter is delivered in said at least one closed position with the exterior front face oriented face-up with instruction to orient said check presenter when payment is ready;

(b) visually monitoring said check presenter; and (c) retrieving said check presenter from said customer when said check presenter is closed and oriented as instructed.

9. The method according to claim 8, wherein a face of said check presenter comprises language signaling the customer to place the exterior back face face-up when payment is ready.

10. The method according to claim 9, wherein said exterior front face comprises language signaling the customer to place the exterior back face face-up when payment is ready.

11. The method according to claim 8, wherein a face of said check presenter comprises language signaling the customer to close the check presenter such that the exterior front face and exterior back face are disposed toward one another when payment is ready.

12. The method according to claim 8, wherein said exterior front face and exterior back face contrast in color with said first interior face and said second interior face.

13. The method according to claim 8, wherein said exterior front face and exterior back face contrast in tone with said first interior face and said second interior face.

14. The method according to claim 8, wherein said exterior front face and exterior back face contrast in pattern with said first interior face and said second interior face.

15. A method for delivering billing information to, and receiving payment or payment information from, a restaurant customer, comprising the steps of:

(a) delivering a check presenter to said restaurant customer, said check presenter comprising a first panel comprising an exterior front face and a first interior face and a second panel comprising a second interior face and an exterior back face, wherein the panels are joined, wherein the joinder permits relative movement of the first panel with respect to the second panel about the joinder to define an open position where the panels rest adjacent each other in the same plane and at least one closed position wherein the first interior face and the second interior face are disposed toward one another, wherein said exterior front face and said exterior back face contrast, wherein a face of said check presenter comprises language signaling the restaurant customer to place the exterior back face face-up when payment is ready;

and wherein said check presenter is delivered in said at least one closed position with the exterior front face oriented face-up;

(b) visually monitoring said check presenter; and (c) retrieving said check presenter from said customer when said check presenter is in said at least one closed position with said exterior back face oriented face-up.

16. The method according to claim 15, wherein said exterior front face and said exterior back face of said check presenter contrast in color.

17. The method according to claim 15, wherein said exterior front face and said exterior back face of said check presenter contrast in tone.

18. The method according to claim 15, wherein said exterior front face and said exterior back face of said check presenter contrast in pattern.

* * * * *